United States Patent [19]

Cordella et al.

[11] 4,362,206

[45] Dec. 7, 1982

[54] SUPPORTING AND GUIDING STAND ARRANGEMENT TO BE USED IN A CONTINUOUS CASTING PLANT

[75] Inventors: Johannes Cordella; Franz Bayer, both of Linz; Erich Felbermayer, Wels, all of Austria

[73] Assignee: Voest-Alpine Aktiengesellschaft, Linz, Austria

[21] Appl. No.: 160,924

[22] Filed: Jun. 19, 1980

[30] Foreign Application Priority Data

Jun. 28, 1979 [AT] Austria ..... 4511/79

[51] Int. Cl.[3] ..... B22D 11/12

[52] U.S. Cl. ..... 164/448; 164/442

[58] Field of Search ..... 164/448, 442; 193/35 R; 226/174, 189

[56] References Cited

U.S. PATENT DOCUMENTS

| | | | |
|---|---|---|---|
| 3,596,706 | 8/1971 | Knorr et al. | 164/448 |
| 3,757,848 | 9/1973 | Scholz et al. | 164/448 |
| 4,007,822 | 2/1977 | Scheurecker | 164/448 |
| 4,018,261 | 4/1977 | Scheinecker et al. | 164/448 |
| 4,034,796 | 7/1977 | Loibl et al. | 164/448 |
| 4,046,188 | 9/1977 | Kagerhuber et al. | 164/448 |
| 4,074,746 | 2/1978 | Scheurecker et al. | 164/442 |
| 4,076,069 | 2/1978 | Scheinecker et al. | 164/448 |
| 4,146,083 | 3/1979 | Scheurecker et al. | 164/448 |

FOREIGN PATENT DOCUMENTS 2021780 2/1971 Fed. Rep. of Germany .

*Primary Examiner*—Gus T. Hampilos
*Assistant Examiner*—J. Reed Batten, Jr.
*Attorney, Agent, or Firm*—Brumbaugh, Graves, Donohue & Raymond

[57] ABSTRACT

A supporting and guiding stand for continuous casting plants comprises roller ways supporting the stand on two opposite sides. One of the roller ways is arranged on a first supporting framework and the other roller way is arranged on a second supporting framework braceable relative to the first supporting framework by means of a number of drawing anchors and connectable to the same. Adjustment drives are provided for adjusting the second supporting framework relative to the first supporting framework. For easily separating the two supporting frameworks and for detaching the two supporting frameworks from each other merely by using the adjustment drives, the latter are connected with the second supporting framework on the one hand and with the drawing anchors on the other hand, in a manner that the drawing anchors are detachably fastened to the first supporting framework and, after release of the connection means, are removable by means of the adjustment drives from the first supporting framework out of a position connecting the supporting frameworks and are retractable into the second supporting framework in a retraction position.

3 Claims, 5 Drawing Figures

SUPPORTING AND GUIDING STAND ARRANGEMENT TO BE USED IN A CONTINUOUS CASTING PLANT

BACKGROUND OF THE INVENTION

The invention relates to a supporting and guiding stand to be used in continuous casting plants, such as continuous casting plates for slabs, comprising two roller ways supporting the strand at two opposite sides, one of the two roller ways being arranged on a first supporting framework and the other roller way being arranged on a second supporting framework which is braceable relative to the first supporting framework by means of a number of drawing anchors and connectable with the same, respectively, adjustment drives being provided for adjusting the second supporting framework relative to the first supporting framework.

A supporting and guiding stand of this kind having an arcuate shape is known from U.S. Pat. No. 4,046,188. With this supporting and guiding stand the first supporting framework is formed by a framework, cross carriers and longitudinal carriers being fastened thereto. The second supporting framework is movable relative to the first supporting framework by means of pressure medium cylinders which are hinged to the cross carriers of the second supporting framework on the one hand and to the framework of the first supporting framework on the other hand, wherein the second supporting framework is displaced along the drawing anchors for the purpose of adjusting the distance of the roller ways.

With this known supporting and guiding stand difficulties may arise when separating the two supporting frameworks, in particular when the drawing anchors connecting the two supporting frameworks are very long, for providing a long displacement path of the second framework. Difficulties also may arise when the supporting and guiding stand extends over a great length of the continuous casting plant, for instance over the entire arc of an arcuate continuous casting plant, wherein a plurality of drawing anchors are provided, the anchors being arranged at an acute angle relative to one another.

Also with similarly constructed supporting and guiding stands for a straight-line supporting length, difficulties may arise when separating the two supporting frameworks. If, for instance, a plurality of drawing anchors are provided, it is difficult to align them precisely parallel to one another. Particularly after longer times of operation, jamming of the drawing anchors may occur in the supporting framework to be lifted, primarily if these are designed very long.

U.S. Pat. No. 4,146,083 discloses an arcuate supporting and guiding stand comprising two supporting frameworks that are braceable towards each other by means of drawing anchors and carry a roller path each, in which the drawing anchors can be detached from one framework and retracted into the other framework. With this supporting and guiding stand, however, the frameworks are not adjustable relative to each other, but rather, are always at the same distance from each other. It is only the arcuate longitudinal carriers arranged on one of the frameworks which are displaceable relative to this framework, wherefor a plurality of pins connecting the arcuate longitudinal carriers with this framework have to be detached individually, adjusted by means of special adjustment means and then fixed again in their new positions on this framework.

SUMMARY OF THE INVENTION

The invention aims at avoiding these disadvantages and difficulties, and has as its object to provide a supporting and guiding stand of the initially-described kind, the supporting frameworks of which are easily separable from each other, e.g., wherein a plurality of drawing anchors are provided, or wherein the drawing anchors are arranged at acute angles to one another due to the arcuate shape of the supporting and guiding stand. In addition, no further means are required for separating the two supporting frameworks from each other, the adjustment drives used to displace the two supporting frameworks relative to each other being sufficient.

According to the invention, the adjustment drives are connected with the second supporting framework on the one hand and with the drawing anchors on the other hand, in a manner that the drawing anchors are detachably fastened to the first supporting framework and, after detachment of the connection means from the position connecting the supporting frameworks, are removable from the first supporting framework by means of the adjustment drives and retractable into the second supporting framework in a retraction position.

In preferred embodiment, each of the two supporting frameworks is formed of cross carriers and of longitudinal carriers mounted thereon, the latter extending over the total length of the stand and carrying the rollers. The drawing anchors connect oppositely arranged cross carriers of the two supporting frameworks and are arranged on the ends of the oppositely arranged cross carriers. The drawing anchors are detachably connected with the cross carriers of the first supporting framework, and the adjustment drives on the one hand are fastened to the cross carriers of the second supporting framework and on the other hand are connected with the outer ends of the drawing anchors.

In order to reliably prevent jamming of the drawing anchors when retracting them into the second supporting framework, and to prevent the need for a special synchronization control of the adjustment drives, two oppositely arranged drawing anchors are each connected by a crosshead hinged to their ends, and the adjustment drives are arranged approximately parallel to the drawing anchors and hinged to the crossheads.

According to a further preferred embodiment, the adjustment drives are arranged between the drawing anchors connected to the crosshead and oppositely arranged. This has the advantage that the supporting and guiding stand can be designed to be particularly narrow, which results in considerable savings, i.e., primarily savings in weight of the cooling chamber surrounding the supporting and guiding stand. The entire continuous casting plant thus becomes more accessible.

Suitably, a relieving means is provided between the cross carriers and the ends of the drawing anchors hinged to the crossheads.

BRIEF DESCRIPTION OF THE DRAWINGS

The invention will now be described in more detail with reference to the accompanying drawings, wherein.

DESCRIPTION OF EXEMPLARY EMBODIMENTS

Figure 1:
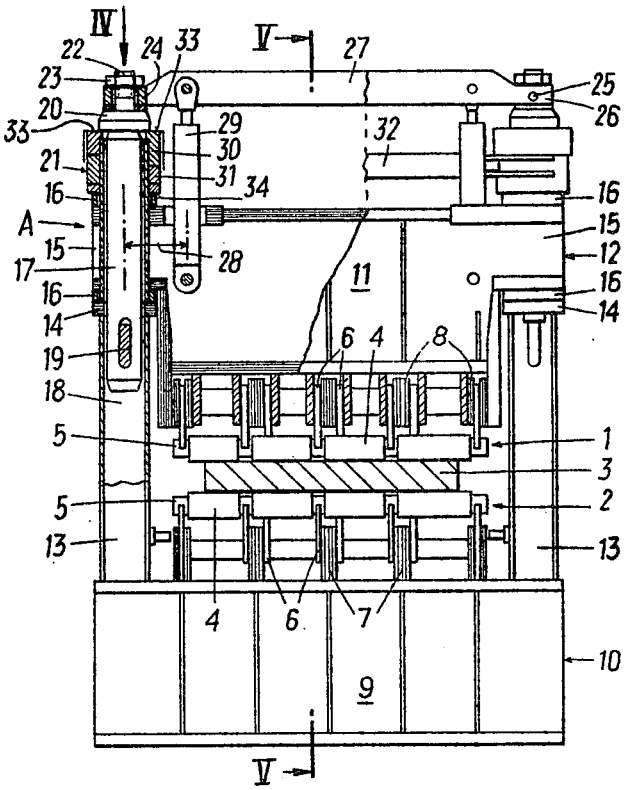
FIG. 1 is a partly sectioned view of the supporting and guiding stand in the direction of the longitudinal axis.
Figure 2:
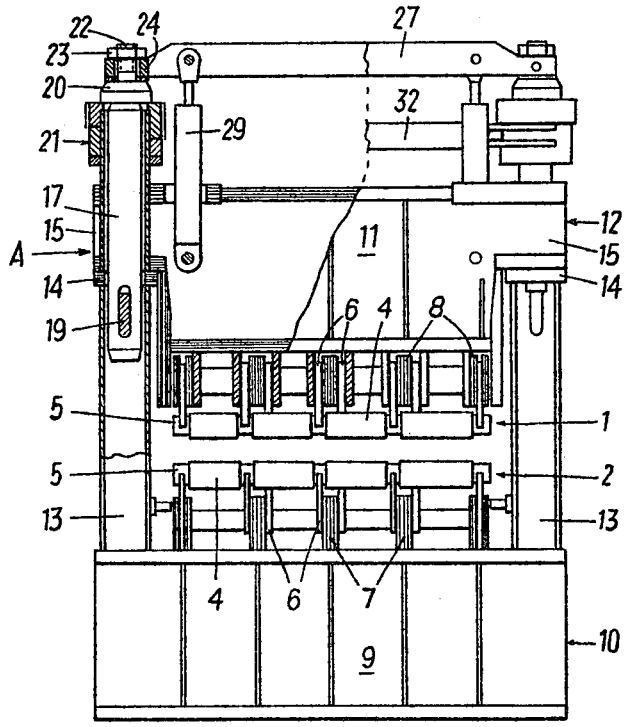
FIG. 2 analogously illustrates the supporting and guiding stand with the roller ways adjusted to the minimum thickness to be cast.

Between the roller ways 1 and 2 the strand 3 is supported and guided. The rollers 4 of each of the roller ways are inserted, via holding means 5, in bearing brackets 6 fastened to longitudinal carriers 7, 8. In order to prevent excessive sagging of the long and relatively thin rollers 4, five holding means 5 distributed over the longitudinal extension of the rollers are provided in the embodiment illustrated. The longitudinal carriers 7 of the lower roller way are fastened to cross carriers 9, forming a first supporting framework 10 together with the cross carriers. The longitudinal carriers 8 of the upper roller way are also mounted to cross carriers 11, forming a second supporting framework 12 together with them. On the cross carriers 9 of the first supporting framework 10, hollow struts 13 are rigidly fastened laterally of the ends of the rollers 4 and comprise flanges 14 on their upper ends. On this flange, an end 15 of a cross carrier 11 of the second supporting framework 12 each rests, either directly (at a minimum distance of the roller ways, FIG. 2) or on interposing shims 16 (at a distance exceeding the minimum distance of the roller ways, FIG. 1). The cross carriers 11 of the second supporting framework 12 are penetrated at both ends 15 by drawing anchors 17 which are in alignment with the inner space 18 of the hollow struts 13 and can be inserted into the cavities. In FIGS. 1 and 2, the drawing anchors are illustrated in a position A connecting the supporting frameworks, in which the drawing anchors project into the struts 13 and are fastened to the struts 13. The fastening of the drawing anchors 17 to the struts is affected by means of inserts 19.

The ends of the drawing anchors 17 projecting beyond the cross carriers of the second supporting framework are each provided with a collar 20. Via a relieving means 21, this collar leans against an end 15 of the cross carrier 11 of the second supporting framework 12, either directly or on interposing shims 16. Above the collar 20 of each drawing anchor 17 a nut 23 is screwed on a thread-comprising extension 22 of the drawing anchor, which nut braces a sleeve 24 against the collar 20. On each sleeve 24 two diametrically oppositely arranged pins 25 are mounted, to which lugs 26 of a beam 27 are hinged. Each beam 27 connects two drawing anchors 17 arranged at the ends 15 of one cross carrier 11. At a slight distance 28 from each drawing anchor 17 a pressure medium cylinder 29 is arranged approximately parallel to the same, which is hinged to the beam 27 on the one hand and to the cross carrier 11 of the second supporting framework on the other hand. The pressure medium cylinders 29 (other adjustment means could be provided instead, e.g., a rotatable spindle or the like) are each located between the drawing anchors 17.

The relieving means 21 comprises two bushings 30, 31 which form a thread through corresponding screw-shaped slide faces. One of the bushings 30, 31 is rotatable relative to the other bushing, i.e., with the help of a pressure medium cylinder 32 which is hinged to one of the two bushings arranged on opposite drawing anchors 17, whereby the distance of the outer supporting surfaces 33, 34 of the bushings 30, 31 between the cross carriers 11 and the collar 20 of the respective drawing anchor 17 can be changed. By means of these bushings 30, 31 it is thus possible to brace a cross carrier 11 of the second supporting framework 12 against the struts 13 and thus against the first supporting framework 10 (with the insert piece 19 interposed) and to release the fixation of the two supporting frameworks 10, 12, respectively. Instead of the bushings 30, 31, wedges penetrating the drawing anchors could be provided.

The operation of the supporting stand is as follows: If the distance of the roller ways 1, 2 is to be changed, the relieving means 21 will be actuated first, i.e., the fixation of the supporting frameworks is detached, whereupon the second supporting framework, by means of the pressure medium cylinder 29, is held in a position which enables exchanging of the shims 16. After removal of the shims 16, the second supporting framework 12 is displaced into the desired new position by means of the pressure medium cylinders 29. Then appropriate shims 16 are inserted above or below the cross carriers 11 of the second supporting framework 12 (depending on the new position of the second supporting framework 12), whereupon bracing of the second supporting framework against the first supporting framework is provided anew by the relieving means 21.

Figure 3:
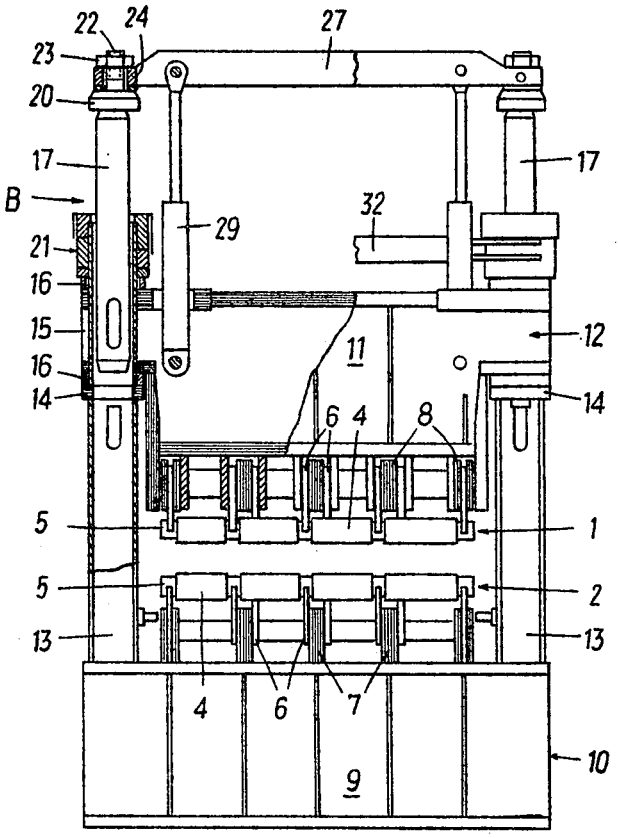
FIG. 3 also analogously illustrates this supporting and guiding stand with the drawing anchors retracted.
Figure 4:
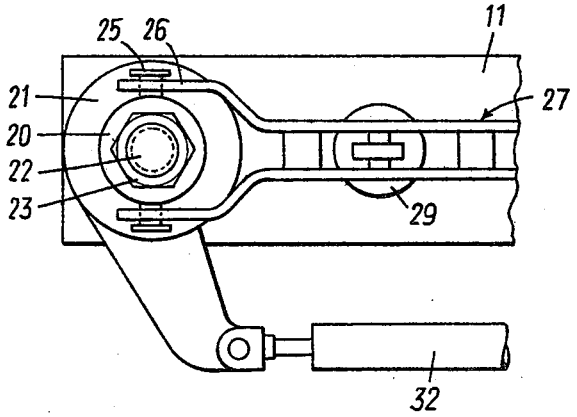
FIG. 4 is a partial view in the direction of the arrow IV of FIG. 1.

For the purpose of separating the supporting frameworks 10, 12 the insert pieces 19, which connect the drawing anchors 17 with the struts 13 of the first supporting framework 10, are removed after release of the bracing by means of the relieving means 21, whereupon the pressure medium cylinders 29 are actuated and the drawing anchors will assume the retraction position B as illustrated in FIG. 3. Then the second supporting framework 12 can be lifted off the first one 10 with the help of the hall crane. When retracting the drawing anchors 17 into the retraction position B, jamming of the drawing anchors 17 within the struts 13 or within the cross carriers 11 of the second supporting framework 12 will be prevented by the crosshead 27.

A particular advantage of the supporting and guiding stand according to the invention is that each of the pressure medium cylinders 29 assumes two functions. First, the cylinders lift and lower the second supporting framework 12 relative to the first one 10 for the purpose of changing the distance of the roller ways 1, 2. Secondly, the cylinder retract the drawing anchors 17 into the retraction position B. This results in a considerable saving of costs and in considerably smaller expenditures when demounting the second supporting framework, since removal of the pressure medium cylinders (from the first supporting framework 10) is not required; it merely suffices to remove the insert pieces 19. When mounting the second supporting framework onto the first one, manipulations at the pressure medium cylinders also can be eliminated.

Figure 5:
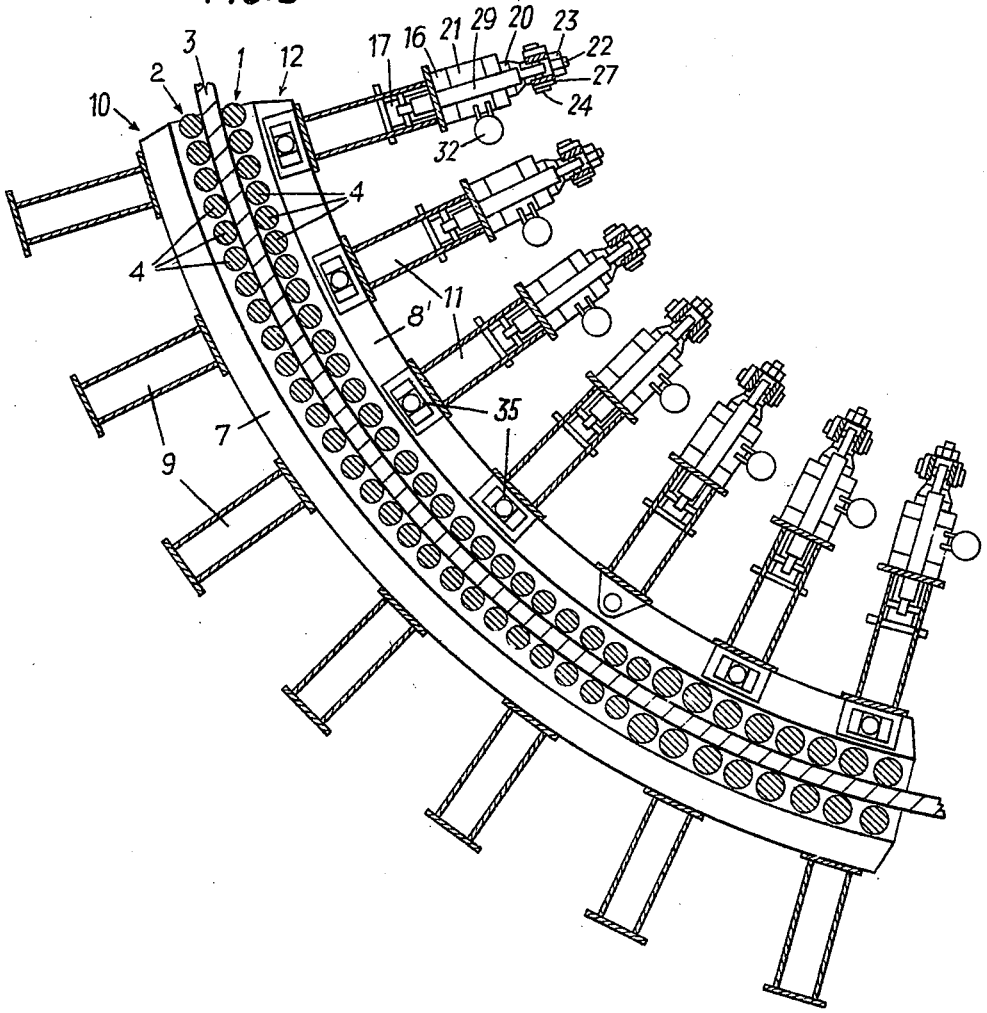
FIG. 5 is a schematic section on a reduced scale according to line V—V of FIG. 1, through an arcuate supporting and guiding stand.

The supporting and guiding stand according to the invention is suited both for straight roller ways and also for arcuate roller ways. With arcuate roller ways (FIG. 5) the arcuate longitudinal carriers 8' of the second supporting framework 12 are fastened to the cross carriers 11 by means of sliding blocks 35 facilitating a longitudinal displacement of the longitudinal carriers 8' relative to the cross carriers 11, as this has been realized in the supporting and guiding stand known from U.S. Pat. No. 4,046,188.

What we claim is:

1. In a supporting and guiding stand arrangement to be used in a continuous casting plant, such as a casting plant for slabs, and of the type including a first supporting framework and an oppositely arranged second supporting framework, each of said first and second supporting frameworks comprising cross carriers, and longitudinal carriers mounted on said cross carriers and extending over the total length of said supporting and guiding stand, a first and a second roller way being provided on the longitudinal carriers of each of said first and second supporting frameworks, respectively, a plurality of drawing anchors for bracing said second supporting framework relative to said first supporting framework and for connecting said second supporting framework to said first supporting framework, and adjustment drives for displacing said second supporting framework relative to said first supporting framework, the improvement comprising connection means for connecting said drawing anchors with said first supporting framework, said drawing anchors being arranged on the ends of the oppositely arranged cross carriers and connecting the oppositely arranged cross carriers of said first and second supporting frameworks, the outer ends of said oppositely arranged drawing anchors being hinged to and connected by crossheads, said adjustment drives being approximately parallel to said drawing anchors and being hingedly connected with said crossheads and being connected with the cross carriers of said second supporting framework, said drawing anchors being detachably connected to the cross carriers of said first supporting framework, whereby after release of said connection means said drawing anchors are removable from said first supporting framework out of a connection position connecting said first and second supporting frameworks and retractable by said adjustment drives into a retraction position in said second supporting framework.

2. A supporting and guiding stand arrangement as set forth in claim 1, wherein said adjustment drives are arranged between said oppositely arranged drawing anchors connected with said crossheads.

3. A supporting and guiding stand arrangement as set forth in claim 1 or 2, further comprising relieving means provided between said cross carriers and the ends of said drawing anchors hinged to said crossheads.

* * * * *